United States Patent [19]

Geke et al.

[11] Patent Number: 5,047,095

[45] Date of Patent: Sep. 10, 1991

[54] PROCESS FOR SIMULTANEOUS SMOOTHING, CLEANING, AND SURFACE PROTECTION OF METAL OBJECTS

[75] Inventors: Juergen Geke; Hermann Drosdziok, both of Duesseldorf; Herbert Wievelhoff, Heiligenhaus, all of Fed. Rep. of Germany

[73] Assignee: Henkel Kommanditgesellschaft auf Aktien, Duesseldorf-Holthausen, Fed. Rep. of Germany

[21] Appl. No.: 297,445

[22] Filed: Jan. 13, 1989

[30] Foreign Application Priority Data

Jan. 14, 1988 [DE] Fed. Rep. of Germany ..... 3800834

[51] Int. Cl.[5] ..... C23C 22/47; C23C 22/08

[52] U.S. Cl. ..... 148/259; 148/253; 148/252

[58] Field of Search ..... 148/259, 252, 253

[56] References Cited

U.S. PATENT DOCUMENTS

| | | | |
|---|---|---|---|
| 3,071,456 | 1/1963 | Chessman | 51/316 |
| 3,268,367 | 8/1966 | Nelson | 148/259 |
| 3,420,715 | 1/1969 | Ayres | 148/258 |
| 4,153,479 | 5/1979 | Ayano | 148/259 |
| 4,474,626 | 10/1984 | Lemaret | 148/259 |
| 4,491,500 | 1/1985 | Michaud | 156/628 |
| 4,705,594 | 11/1987 | Zobbi | 148/252 |
| 4,724,042 | 2/1988 | Sherman | 156/645 |
| 4,818,333 | 4/1989 | Michaud | 156/645 |

FOREIGN PATENT DOCUMENTS

| | | | |
|---|---|---|---|
| 440986 | 3/1927 | Fed. Rep. of Germany . | |
| 2819912 | 11/1978 | Fed. Rep. of Germany | 148/259 |
| 3032124 | 6/1991 | Fed. Rep. of Germany . | |
| 1423822 | 11/1964 | France . | |
| 0094600 | 9/1969 | France | 148/259 |
| 931003 | 7/1963 | United Kingdom | 51/316 |

*Primary Examiner*—Sam Silverberg

*Attorney, Agent, or Firm*—Ernest G. Szoke; Wayne C. Jaeschke; Norvell E. Wisdom, Jr.

[57] ABSTRACT

By using an aqueous solution containing a phosphoric acids or phosphate salts together with carboxylic acids containing at least two carboxyl groups per molecule along with conventional mass finishing, a wide variety of metal parts may be simultaneously deburred, cleaned, and provided with a surface with good resistance to corrosion in humid air. The solution used preferably also contains non-ionic surfactant, corrosion inhibitor, and, for use in hard water areas, a water hardness stabilizer.

4 Claims, No Drawings

PROCESS FOR SIMULTANEOUS SMOOTHING, CLEANING, AND SURFACE PROTECTION OF METAL OBJECTS

FIELD OF THE INVENTION

This invention relates to a process and composition for simultaneous smoothing, cleaning, and surface protection of metal objects by mass finishing in the presence of a novel type of treating solution.

DESCRIPTION OF RELATED ART

Nowadays, metal workpieces or consumer goods are largely mass-produced by automated industrial processes. The surfaces of such metal parts, which may be made, e.g., of steel, cast iron, copper and its allows, aluminum and its alloys, zinc, magnesium and other metals, generally have to be improved after they are first shaped before they are directly marketed, used as intended, or further processed or assembled.

Metal objects produced by turning, milling, casting or similar processes for treating metals frequently have sharp cut edges or corners or even rough surfaces covered by layers of scale, so that the cut edges and corners have to be trimmed and rounded off and, in many cases, the surface as a whole also has to be smoothed or polished. The quality of surface layers subsequently applied to objects of the type in question depends to a large extent on how well the metal surface has been prepared for the application of such additional refining, protective, and/or decorative layers. For example, the electroplating of metals can proceed satisfactorily only if the electroplating process has been preceded by proper preparation of the surface to be plated. In particular cases, this surface preparation may require cleaning, descaling, and/or grinding of the surface.

Metal workpieces or castings may be shaped, smoothed and finished by a variety of means, including manual mechanical trimming, grinding, rubbing with emery, brushing and polishing, or combined mechanical and chemical finishing process. The purely manual/mechanical finishing of metal parts, particularly small parts produced in large numbers, is no longer economically viable. It is therefore being increasingly replaced by a technique called "mass finishing", which is defined and described in general terms between pages 77 and 98 of *Metal Finishing,* published by Metals and Plastics Publications, Inc., Hackensack, N.J. in 1985. The non-advertising text and figures of the noted section of *Metal Finishing* are hereby incorporated herein by reference.

Combined mechanical and chemical finishing may be accomplished in mass finishing by using a chemical composition, usually called "compound" in the art and in this specification, along with the abrasive media and metal objects to be finished. The workpieces are brought into sliding contact with the grinding media, which may be pebble stones, dolomite, quartz, synthetic ceramic or resin bonded corundum, aluminum oxide, silicon carbide or boron carbide of various shapes and, at the same time, are sprayed with usually water-based compositions specially developed for mass finishing. The size and external shape, such as triangles, cylinders, stars, cones, spheres, and the like, and the roughness of the grinding media provide for finishing of the metal surfaces by abrasion and, optionally, polishing. Metal workpieces and/or castings can be descaled, trimmed, ground, smoothed, burnished and polished by mass finishing.

The chemical treatment preparations ("compounds") used for mass finishing are adapted in their composition and concentration to the metal surfaces which are to be finished, but also have to take into account special characteristics of the particular mass finishing process. The principal functions of such treatment compounds are to ensure good cleaning, dispersing, and soil-suspending power, so that oil and grease are emulsified and the grit emanating from the media and the workpieces is completely removed and not deposited onto the workpieces. In addition, the compounds are intended to prevent corrosion of the metal workpieces or castings and also favorably to influence the grinding effect and/or polishing effect during the mass finishing process. To this end, the compounds must not smear the castings during grinding with a greasy layer which would mar the shine produced by polishing of the castings. In addition, compounds of the type in question, through their composition, can affect the grinding effect of the media, thus making it possible first to trim and pre-grind and, after the chemical treatment compound has been changed, to finish and polish the workpieces with the same media.

The compounds are normally prepared in such a way that they may be dispensed in liquid, concentrated or prediluted form by means of automated pumps. Mass finishing compounds normally dissolve in water to produce neutral to mildly alkaline solutions and contain combinations of soil emulsifying and corrosion-inhibiting substances.

A disadvantage of state-of-the-art products, generally developed purely by trial and error, is that a compound of different composition has to be used for each application, i.e. for each metal of the workpieces or castings. This means that the mass finishing process equipment has to be completely changed over or cleaned whenever the workpieces to be treated by mass finishing are changed. Another disadvantage is that satisfactory mass finishing results can only be obtained when the surfaces of the metal workpieces or castings have been carefully cleaned and surface treated before mass finishing. Accordingly, the actual mass finishing process had to be preceded by treatment processes to prepare the metal surfaces in the desired condition. Apart from the fact that these preliminary treatment steps require separate plants and chemicals, the effect of the mass finishing compounds and, hence, the success of the mass finishing process are easily spoiled when the cleaning and treating compositions are carried over into the mass finishing unit. As a result, the mass finishing compounds can only exert their effect to a limited extent.

DESCRIPTION OF THE INVENTION

Except in the operating examples or where otherwise explicitly specified, all numerical quantities in this specification describing amounts or dimensions of materials or reaction conditions are to be understood as if modified by the work "about".

It has now surprisingly been found that it is possible to perform mass finishing in the presence of an appropriate liquid composition and combine the deburring and shaping effects of ordinary mass finishing with cleaning and surface protective effects that are conventionally performed in separate steps. Only one "compound", which has a cleaning and passivating or surface protective effect and also promotes mass finishing, need be used. It is thus possible to avoid the practical disadvantages of a three-step process using three solutions of different composition.

The process embodiments of the present invention are characterized by the fact that the mass finishing is performed while the metal workpieces are in contact with aqueous solutions which have a pH value in the range from 1 to 6 and which contain orthophosphoric acid and/or condensed phosphoric acids and/or water-soluble salts thereof, one or more carboxylic acids having either two or three carboxyl groups per molecule, such acids being designated hereinafter as "oligocarboxylic" acids and, optionally, one or more surfactants, one or more corrosion inhibitors and other active substances and/or auxiliaries typically present in cleaning, surface protecting, and mass finishing preparations.

The composition embodiments of the present invention contain orthophosphoric acid and/or condensed phosphoric acids and/or water-soluble salts thereof, one or more oligocarboxylic acids and, optionally, one or more surfactants, one or more corrosion inhibitors and, optionally, other active substances and/or auxiliaries typically present in cleaning, surface protecting and mass finishing compounds and, optionally, water.

The process according to the invention and the compounds used therein for the simultaneous mass finishing, cleaning and passivation or surface protective treatment of metal workpieces may be applied to metal workpieces and/or castings of various different compositions. Thus, workpieces or castings of iron and all its alloys, for example steels of different composition, cast iron, etc., copper and its alloys, for example brass, bronze, etc., aluminum alloys, zinc or magnesium, and other metals or alloys, may be treated in the course of the process. The surprising aspect of the process according to the invention is that not only can the actual mechanical/ chemical surface treatment of mass finishing, which is normally carried out in drums or vibrators, be carried out using these solutions, the step—normally carried out beforehand—of cleaning the metal workpieces or castings and surface protecting the particular metal surface is also carried out using the same solutions and in one and the same process step without any need for additional units or treatment solutions. Thus, the particular metal surface is cleaned, descaled, surface protected, trimmed, ground, smoothed, burnished and polished in one and the same step. According to the invention, this is done by bringing the workpieces into contact with aqueous solutions having a pH value in the range from 1 to 6. Solutions having a pH value in the range from 3.5 to 5 are preferred. The workpieces or castings are brought into contact with the aqueous solutions by immersing or spraying, depending on the unit. In the process according to the invention, the aqueous solutions according to the invention are normally applied by spraying the workpieces or castings with the aqueous solutions in the units (drums, vibrators, etc.), in which the workpieces are moved together with the media, and allowing the aqueous solutions to run through between the workpieces and the media to the bottom of the particular unit. The solutions are in contact with the surfaces of the media and with metallic surfaces in the intervening period. It is preferable, but not necessary, in the practice of this invention to circulate the solutions used, so that they carry the soil and also the metal particles and/or media particles detached during the process out of the treatment zone, are freed from such impurities after issuing from the unit, and are brought back into contact with the workpieces and/or castings.

In the process according to the invention, the workpieces and castings are brought into contact with aqueous solutions which contain phosphoric acid and/or condensed phosphoric acids and/or water-soluble salts thereof as one of the essential components. Condensed phosphoric acids are understood to be any of those compounds which are formed by the condensation of several phosphate groups onto one another. In one preferred embodiment of the process according to the invention, alkali metal salts and/or ammonium salts or orthophosphoric acid and/or condensed phosphoric acids are used as the phosphate components. Accordingly, suitable alkali metal salts are lithium salts, sodium salts, potassium salts, rubidium salts or cesium salts, of which the potassium salts and, in particular, the sodium salts are preferred by virtue of their ready availability.

Suitable ammonium salts are both those containing an $NH_4^+$ cation and also those ammonium salts which contain one or more organic substituents on the nitrogen atom. Of these organoammonium compounds, those which contain one or more alkyl radicals having a linear or branched chain and 1 to 6 carbon atoms in the alkyl radical are particularly preferred. Of the ammonium salts, the $NH_4^+$ salts are particularly preferred and may be used with advantage as phosphate components in the aqueous solutions used in the process according to the invention.

In one preferred embodiment of the process according to the invention, the workpieces are brought into contact with acidic aqueous solutions containing one or more of the phosphate components mentioned in quantities of 0.2 to 10% by weight. The quantities by weight are based on the prepared in-use solution and indicate the content of specified substance used in such in-use solutions.

The process according to the invention for the simultaneous mass finishing, cleaning and surface protection of metal workpieces is further characterized by the fact that the workpieces or castings are brought into contact with aqueous solutions containing one or more oligocarboxylic acids as another essential component. According to the invention, individual compounds or mixtures or dicarboxylic acids and tricarboxylic acids are preferably used as the oligocarboxylic acids. In another preferred embodiment of the process, the dicarboxylic acid tricarboxylic acids may be substituted by polar groups in the alkylene radical. The polar substituents are, primarily, hydroxy groups. Tartaric acid or citric acid or mixtures of these two carboxylic acids are particularly preferred dicarboxylic acids and tricarboxylic acids for the process according to the invention.

In another preferred embodiment of the process, aqueous solutions containing one or more of the carboxylic acid components mentioned in quantities of 0.01 to 1% by weight are used. As in the case of phosphate components, the quantities by weight are based on the specified substance content of the final in-use solutions.

Another component of the aqueous solutions used in the process according to the invention are, optionally, surfactants. In this case, too, the aqueous solutions may contain one or even more surfactants as surface-active components. It is preferred to use individual compounds or mixtures of solely nonionic surfactants or, instead, combinations of one or more ionic surfactants with one or more anionic surfactants or, alternatively, one or more cationic surfactants. By virtue of their favorable cleaning properties and the fact that they promote the mass finishing process in a particular way, aqueous solutions containing combinations of one or more anionic surfactants with one or more anionic surfactants or, alternatively, with one or more cationic surfactants are particularly preferred for use in the process according to the invention. Combinations containing nonionic and anionic or, alternatively, cationic surfactants in a quantitative ratio of 1:1 to 10:1 may be used with particular advantage. In the process according to the invention, the total quantities of surfactants present in the aqueous solutions used amount to between 0 and 2% by weight and preferably to between 0.005 and 2% by weight. These quantities are also based on the specified substance content in the in-use solution.

In another embodiment of the process, the aqueous treatment solutions optionally contain one or more corrosion inhibitors. The corrosion inhibitors have to be coordinated with the particular constituent metal of the metal workpieces or castings which are to be processed according to the invention. Aqueous solutions in which one or more compounds from the group consisting of alkali metal molybdates, preferably sodium molybdates, benzotriazole, tolyl triazole and benzthiazole are used as corrosion-inhibiting components are preferably used. These corrosion inhibitors which, like the other components, may be used individually or in the form of combinations of several components active in the same manner are present in quantities of 0 to 0.02% by weight and preferably in total quantities of 0.001 to 0.2% by weight. As with the other components, these quantities are also based on the specified substance content in the in-use solution.

The process may be carried out using acidic aqueous solutions which, in addition to the components described generally or in detail above, also contain other typical active substances and/or auxiliaries known per se. Such active substances may be, for example, water hardness stabilizers. They may be used with particular advantage when the compounds used for the process have been prepared with water containing relatively large quantities of hardness salts, particularly alkaline earth metal carbonates. Examples of such water hardness stabilizers are phosphonic acids or derivatives thereof such as, for example, hydroxyethane diphosphonic acid (HEDP) or phosphonobutane tricarboxylic acid (PBTC) or water-soluble salts thereof, and also ethylenediaminetetraacetic acid or water-soluble salts thereof, nitrilotriacetic acid and water-soluble salts thereof, or other compounds known for such purposes from the prior art. They are present in quantities from 0 to 0.2% by weight and, preferably—providing their co-use in desired—in quantities of 0.01 to 0.2% by weight and enable even "hard" water to be used in the process according to the invention.

As described above, aqueous solutions such as these are normally brought into contact with the metal workpieces or castings by dipping or spraying in the process according to the invention, the surfaces of the workpieces being abraded, cleaned, and protected against atmospheric corrosion at one and the same time. This treatment is normally carried out at temperatures in the range from 20° to 60° C., but preferably at room temperature. The treatment times depend to a large extent on the degree of soiling, on the size of the burrs and ridges to be removed, on the hardness, size and shape of the media and also on the properties of the aqueous treatment solutions. In preferred embodiments of the process, the treatment times are between 10 and 60 minutes. Normally, the surface treatment is followed solely by drying. This drying step may be carried out at room temperature by the drum process using typical aids, such as, for example, crushed corn, sawdust, etc., or by means of hot air. In special cases, however, the drying step may be preceded by a rinsing step. This depends largely on the nature of the further treatment of the workpieces or castings treated by the process according to the invention.

The present invention also comprises some of the "compounds" used in the process described above. These compounds contain orthophosphoric acid and/or condensed phosphoric acids and/or water-soluble salts thereof and one or more oligocarboxylic acids and, optionally, one or more surfactants, one or more corrosion inhibitors and other active substances and/or auxiliaries typically present in cleaning and surface protecting compositions and/or mass finishing compounds. The compounds may either be made in powder form and packed as such, simply being stirred into water at the time and place of use, or alternatively may be made in the form of highly concentrated aqueous solutions and merely diluted at the time of use. The advantage of the first alternative is that only the pure substance need be transported, i.e. water does not have to be unnecessarily transported. The second alternative is of advantage because liquid concentrates can be automatically dispensed at the point of use by means of metering pumps, so that they are convenient to handle for the user. The aqueous solutions marketed in the form of concentrates are homogeneous. Aqueous concentrates normally have a pH value in the range from 1 to 6 due to the components present in them. The pH value is preferably in the range from 3.5 to 5. If, however, the pH value should not lie within this range due to the use of relatively strong alkaline components, it may optionally be adjusted through the addition of non-corrosive acids, preferably for example phosphoric acids, phosphonic acids, phosphono- carboxylic acids or carboxylic acids. However, pH adjustment is normally not necessary. The aqueous in-use solutions are normally used with an active substance content in the range from about 0.2 to about 14% by weight.

The compounds according to the invention for the simultaneous mass finishing, cleaning and surface protection of metal workpieces contain alkali metal salts and/or ammonium salts of orthophosphoric acid and/or condensed phosphoric acids as phosphate components. Preferred phosphate components in the compounds according to the invention are acidic sodium phosphates and/or acidic sodium salts of condensed phosphoric acids. Other essential components of the compounds according to the invention are oligocarboxylic acids. From this group, the compounds may contain either a single compound or a mixture of several compounds, i.e. a mixture of several dicarboxylic acids or a mixture of several tricarboxylic acids or even a mixture of one or more dicarboxylic acids and one or more tricarboxylic acids. Dicarboxylic acids and/or tricarboxylic acids substituted by polar groups are preferably used. From the group of such compounds, tartaric acid and citric acid are particularly preferred as carboxylic acid components.

Surfactants are another, optional component of the compounds according to the invention. They may also be present as individual compounds or in combination with one another. The following combinations are preferred as surfactant components in the compounds according to the invention: either one or more nonionic surfactants may be used as the surfactant components or the compounds may contain combinations of one or more nonionic surfactants with one or more anionic surfactants or, alternatively, also combinations of one or more nonionic surfactants with one or more cationic surfactants. In such combinations of several surfactants of different chemical composition, which have a particularly advantageous effect in the compounds according to the invention and develop an excellent cleaning effect, combinations of nonionic surfactants with anionic or cationic surfactants in a quantitative ratio of 1:1 to 1:10 are particularly preferred.

Many different compounds known per se as surfactants from the prior art may be considered as surfactants for the compounds according to the invention. Thus, suitable nonionic surfactants include condensation products of ethylene oxide and/or propylene oxide with fatty alcohols or fatty amines, i.e. alcohols and/or amines containing 6 to 18 carbon atoms in a linear or branched alkyl radical. Other suitable nonionic surfactants are polyalkylene glycol ethers corresponding to the formula $R'—O—[(CH_2)_m—O]_n—R''$, in which R' is a linear or branched alkyl radical containing from 8 to 18 carbon atoms, R'' is an alkyl radical containing 4 to 8 carbon atoms, m is an integer of 2 to 4 and n is an integer of 7 to 12.

Polyalkylene glycol ethers corresponding to the above general formula are well known as low-foaming nonionic surfactants and, in some cases, even as pronounced foam inhibitors, and are therefore particularly suitable.

Where anionic surfactants are used in the compounds according to the invention, they may be, for example, fatty alcohol ether sulfate and/or fatty alcohol ether sulfonates derived from the fatty alcohols defined above. Other suitable anionic surfactants are fatty acids and water-soluble salts thereof and also naphthalene sulfonic acid and water-soluble salts thereof.

Cationic surfactants which are used in combination with nonionic surfactants in the preferred embodiments of the compounds according to the invention are, typically, ammonium compounds containing one or more alkyl radicals, aryl radicals or aralkyl radicals containing more than 6 carbon atoms. Ammonium compounds such as these typically contain at least one linear alkyl radical containing more than 12 carbon atoms and preferably from 14 to 18 carbon atoms. The anions of such ammonium salts are, typically, anions of non-corrosive acids. Examples of such compounds are lauryl dimethyl benzyl ammonium salts, benzyl trimethyl ammonium salts, trialkyl hydroxyalkyl ammonium salts (such as for example butyl dimethyl-2-hydroxydodecyl ammonium benzoate or bis-(benzyl dimethyl-2-hydroxydodecylammonium)succinate or N-benzyldimethyl-2-hydroxydodecylammonium)benzoate, or cyclic quaternary ammonium compounds, such as imidazolinium salts and derivatives thereof substituted in the 1- and 2-position.

In addition, the compounds according to the invention may optionally contain one or more corrosion inhibitors. The corrosion inhibitors are normally adapted to the particular application envisaged and, hence, are determined by the metal surfaces which are to be cleaned, passivated and subjected to mass finishing. Suitable corrosion inhibitors may also be used in combination with one another, with the advantage that the compounds thus formulated according to the invention may be used for a larger number of applications. For most common metals, one or more preferred corrosion inhibitors may be selected, as is known in the art, from the group consisting of alkali metal molybdates, preferably sodium molybdates, benzotriazole, tolyltriazole, and benzthiazole.

The compounds according to the invention may also contain other active substances and/or auxiliaries known per se for cleaning, surface protecting, and mass finishing compounds. One type of additional active substances in question, which are also used in preferred embodiments of the compounds according to the invention, are water hardness stabilizers. The water hardness stabilizers used may be individual compounds or combinations from the group consisting of phosphonic acid derivatives (such as for example hydroxyethyl diphosphonic acid, phosphonobutane tricarboxylic acid, or water-soluble salts thereof), ethylenediaminetetraacetic acid and salts thereof, and nitrilotriacetic acid and water-soluble salts thereof.

As mentioned in detail above, the compounds according to the invention may be made up as powders, i.e. as 100% active substance, or also as concentrates.

In one preferred embodiment of the invention, the compounds according to the invention are present as powders and have the following composition:

(a) orthophosphoric acid and/or condensed phosphoric acids and/or water-soluble salts thereof in quantities of 50 to 98% by weight, (b) one or more oligocarboxylic acid(s) in quantities of 1 to 10% by weight, (c) optionally one or more surfactant(s) in quantities of 0 to 20% by weight and preferably in quantities of 0.1 to 20% by weight, (d) optionally one or more corrosion inhibitors in quantities of 0 to 0.5% by weight and preferably in quantities of 0.01 to 0.5% by weight, (e) optionally other active substances and/or auxiliaries known per se for mass finishing, cleaning and surface protecting compounds in quantities of 0 to 20% by weight and preferably in quantities of 1 to 20% by weight.

In another, equally preferred embodiment of the invention, the compounds according to the invention are present in the form of aqueous concentrates, i.e. in addition to the active substances, such concentrates also contain water which balances the total quantity of all the components to 100% by weight. These aqueous concentrates have the following composition:

(a) orthophosphoric acid and/or condensed phosphoric acids and/or water-soluble salts thereof in quantities of 10 to 50% by weight, (b) one or more oligocarboxylic acid(s) in quantities of 0.5 to 5% by weight, (c) optionally one or more surfactant(s) in quantities of 0 to 10% by weight and preferably in quantities of 0.2 to 10% by weight, (d) optionally one or more corrosion inhibitors in quantities of 0 to 0.1% by weight and preferably in quantities of 0.01 to 0.1% by weight, (e) optionally other active substances and/or auxiliaries known per se for mass finishing, cleaning and surface protecting compounds in quantities of 0 to 1% by weight and preferably in quantities of 0.05 to 1% by weight, and (f) the balance water.

Concentrates of the type noted are diluted with more water by the user at the point of use, or the powder-form "compounds" are dissolved in water. As already mentioned, the in-use solutions have an active substance content of from about 0.2 to about 14% by weight. Accordingly, water is added to the total quantities of the components mentioned in detail above in such a quantity that the total quantity of all the components adds up to 100% by weight. pH valves in the range from 1 to 6 and preferably in the range from 3.5 to 5 are typically established for the in-use solutions, depending on the individual components used. Should such pH values not be reached solely by the components mentioned in the in-use solutions according to the invention, other acids may optionally be added. However, those acids should not be corrosive and preferably emanate from the group consisting of phosphoric acids, phosphonic acids, phosphonocarboxylic acids, and carboxylic acids.

The invention is illustrated by the following operating Examples, which do not limit the scope of the invention.

GENERAL PROCEDURE FOR THE OPERATING EXAMPLES

Machined or cast objects of iron, brass, aluminum alloy of the composition $AlSi_17Cu_4Mg$ (Silumin), bronze, copper, a magnesium alloy of the composition $MgMn_2$, and zinc were taken directly from production and cleaned, surface-protected, and subjected to mass finishing in a single step in a "Labor-Vibrator" machine sold under the brand "finish" by the German firm Sonnberg. The container of this machine was filled about three-quarters full with metal objects and ceramic media, and about 0.1 liter of the process solutions described below in the Examples was added before beginning vibration under the fixed conditions characteristic of the machine, for the time given in the Examples. After the one-step surface treatment, the workpieces were partially rinsed with tap water (which had a hardness equivalent to a content of about 2.7 mmoles/l of combined calcium and magnesium ions), and dried with crushed corn or hot air (100° C.). The surfaces were then visually evaluated.

EXAMPLE 1

An in-use solution of the following composition in weight percent was used:

98% $H_2O$;
0.63% $Na_2H_2P_2O_7$;
1.17% $NaH_2PO_4$;
0.08% citric acid;
0.06% of an adduct of an average of 12 moles of ethylene oxide (EO) per mole of amine with a mixture of primary amines having the same carbon chains as the acyl groups in natural coconut oil; this adduct mixture is arbitrarily designated subsequently herein as "CA-EO";
0.06% of a mixture of molecules having the general formula $R'—O—[(CH_2)_2—O]_n—R''$, in which R'' is butyl, R' is a $C_{12}$–$C_{18}$ linear alcohol, and the average value of n for the mixture is 9.1; this mixture is arbitrarily designated subsequently herein as "FA-EO-BE".

The metal parts were mass finished for 20 minutes at 25° C. while mixed with this solution, which had a pH value of 3.5. The result of this one-step process showed that degreasing and passivation had been very effective and that the metal burrs stemming from production had been completely removed. The steel parts had an iridescent bluish passivation layer. The surfaces of the nonferrous metals were all bright and smooth and showed no signs of corrosion or tarnishing. Even after storage for several weeks in an atmosphere of medium relative humidity, no sign of corrosion could be detected on the metal surfaces.

It should again be emphasized at this juncture that the process according to the invention is a one-step process in which the surfaces to be treated are both degreased and deoxidized/passivated and also deburred in a single operation.

EXAMPLE 2

Castings were treated with an aqueous solution of the following composition (pH 3.7) in the same way as described in Example 1:

98.096% $H_2O$;
1.40% $NaH_2PO_4$;
0.108% tartaric acid;
0.06% phosphonobutane tricarboxylic acid;
0.20% naphthalene sulfonic acid;
0.012% of CA-EO;
0.12% of FA-EO-BE
0.004% $Na_2MoO_4$.

The castings were brought into contact (sprayed) with the above aqueous solution for 40 minutes at 25° to 30+ C. while simultaneously being mass finished. The degreasing, surface protecting and deburring effects were excellent. The steel parts had an iridescent bluish passivation layer. Castings of brass and copper had a bright surface and were oxide-free. Alloys of aluminum also has a bright surface.

EXAMPLE 3

Following the procedure of Examples 1 and 2, metal castings were brought into contact during mass finishing with aqueous solutions having the following composition:

94.85% $H_2O$;
1.57% $Na_2H_2P_2O_7$;
2.93% $NaH_2PO_4$;
0.10% citric acid;
0.10% tartaric acid;
0.15% of CA-EO;
0.15% of FA-EO-BE and
0.15% lauryl dimethyl benzyl ammonium chloride.

Both here and in the preceding Examples, the quantities by weight are based on the specified substance content of the particular components in the in-use solution.

The castings or metal surfaces were treated with the above solution for 15 minutes at 20° to 30° C. Complete degreasing or cleaning and very good passivation/-deoxidation of the metal surface layer were obtained. In addition, mass finishing in the presence of aqueous solutions such as these led to entirely satisfactory deburring.

The metal workpieces or castings were rinsed with water and then dried with hot air. Thereafter, steel parts showed an iridescent bluish passivation layer with good long-term protection against rust. Castings of brass and copper showed bright, oxide-free surfaces. Castings of aluminum and its alloys remained bright.

What is claimed is:

1. In a process for mass finishing metal workpieces, the improvement wherein the workpieces are in contact for a period of from about 10 to about 60 minutes during the mass finishing with an aqueous solution having a pH value of about 1 to about 6 and consisting essentially of water and:

(a) from about 0.2 to about 10 weight % of materials selected from the group consisting of orthophosphoric acid, condensed phosphoric acids, and water soluble salts of orthophosphoric and condensed phosphoric acids;

(b) from about 0.01 to about 1 weight % of materials selected from the group of tartaric acid, citric acid, and mixtures thereof;

(c) from about 0.005 to about 2 weight % of surfactant, of which at least about 50 weight % of the total amount of surfactant is non-ionic; and (d) from about 0.001 to about 0.02 weight % of a corrosion inhibitor selected from the group consisting of alkali metal molybdates, benzotriazole, tolyl triazole, benzthiazole, and mixtures of any of these materials; and, optionally (e) from about 0.01 to about 0.2 weight % of a water hardness stabilizer.

2. A process according to claim 1, wherein not more than about 90 weight % of the total amount of surfactant in the aqueous solution is nonionic.

3. A process according to claim 1, wherein water hardness stabilizer is present and is selected from the group consisting of phosphonic acids and derivatives thereof, ethylenediaminetetraacetic acid and water-soluble salts thereof, nitrilotriacetic acid and water-soluble salts thereof, and mixtures of any of these materials.

4. A process according to claim 2, wherein water hardness stabilizer is present and is selected from the group consisting of phosphonic acids and derivatives thereof, ethylenediaminetetraacetic acid and water-soluble salts thereof, nitrilotriacetic acid and water-soluble salts thereof, and mixtures of any of these materials.

* * * * *